US006726832B1

(12) United States Patent
Baldassari et al.

(10) Patent No.: US 6,726,832 B1
(45) Date of Patent: Apr. 27, 2004

(54) MULTIPLE STAGE CATALYST BED HYDROCRACKING WITH INTERSTAGE FEEDS

(75) Inventors: Mario C. Baldassari, Westwood, NJ (US); Wai Seung Louie, Brooklyn, NY (US); Ujjal Kumar Mukherjee, Montclair, NJ (US)

(73) Assignee: ABB Lummus Global Inc., Bloomfield, NJ (US)

( * ) Notice: Subject to any disclaimer, the term of this patent is extended or adjusted under 35 U.S.C. 154(b) by 405 days.

(21) Appl. No.: 09/638,374

(22) Filed: Aug. 15, 2000

(51) Int. Cl.[7] ..... C10G 65/10; C10G 65/02
(52) U.S. Cl. ..... 208/59; 208/58; 208/153
(58) Field of Search ..... 208/58, 59, 153

(56) References Cited

U.S. PATENT DOCUMENTS 1,974,057 A * 9/1934 Steffen et al. ..... 208/59
3,579,436 A * 5/1971 Mounce ..... 208/59
3,681,231 A * 8/1972 Alpert et al. ..... 208/59
4,082,647 A * 4/1978 Hutchings et al. ..... 208/78
4,243,519 A * 1/1981 Schorfheide ..... 208/210
4,579,648 A * 4/1986 Baird, Jr. ..... 208/138
4,618,412 A * 10/1986 Hudson et al. ..... 208/59
4,707,466 A * 11/1987 Beaton et al. ..... 502/313
4,762,607 A * 8/1988 Aldridge et al. ..... 208/59
4,765,882 A * 8/1988 Aldridge et al. ..... 208/59
5,522,983 A * 6/1996 Cash et al. ..... 208/59
5,980,729 A * 11/1999 Kalnes et al. ..... 208/89
6,096,190 A * 8/2000 Cash ..... 208/89
6,106,694 A * 8/2000 Kalnes et al. ..... 208/57

* cited by examiner

*Primary Examiner*—Walter D. Griffin
(74) *Attorney, Agent, or Firm*—Alix, Yale & Ristas, LLP

(57) ABSTRACT

High boiling hydrocarbon materials are hydrocracked in a multiple stage process having ebullating or fixed catalyst bed hydrogenation reactor stages in series. Between the hydrogenation reactors is an interstage feed of an aromatic solvent and/or a portion of the high boiling hydrocarbon feedstock.

6 Claims, 1 Drawing Sheet

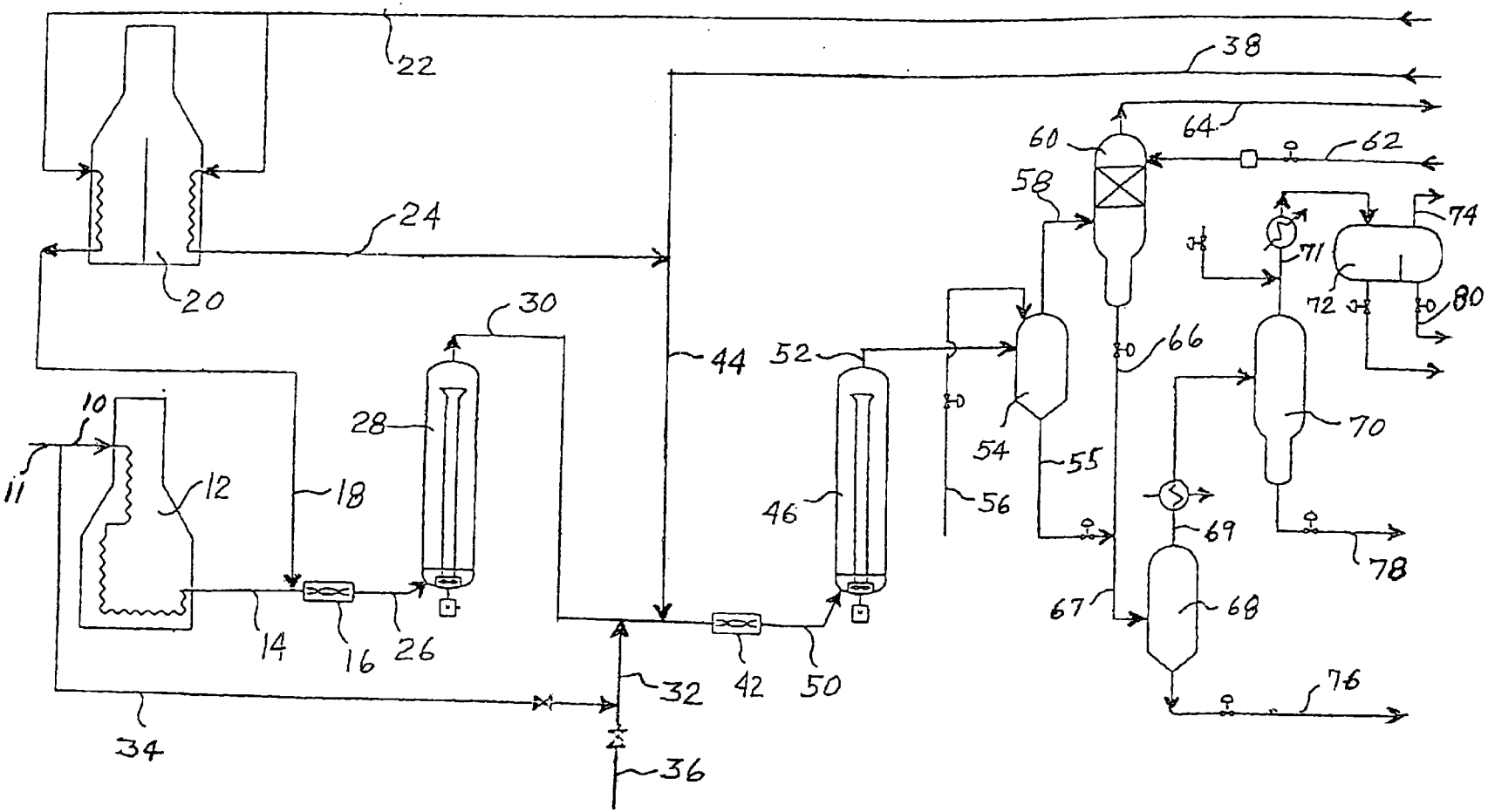
10
11
12
14
16
18
20
22
24
26
28
30
32
34
36
38
42
44
46
50
52
54
55
56
58
60
62
64
66
67
68
69
70
71
72
74
76
78
80

MULTIPLE STAGE CATALYST BED HYDROCRACKING WITH INTERSTAGE FEEDS

BACKGROUND OF THE INVENTION

This invention relates to hydrocracking and more particularly to the hydrocracking of high boiling hydrocarbon materials to provide valuable lower boiling materials.

High boiling hydrocarbon materials derived from petroleum, coal or tar sand sources, usually petroleum residuum or solvent refined coal, are typically hydrocracked in ebullated (expanded) bed or fixed bed catalytic reactors in order to produce more valuable lower boiling materials such as transportation fuels or lubricating oils. In order to obtain a desired degree of hydrogenation for hydrocracking and hydrotreating, there are typically several reactors in series. As an example, see U.S. Pat. No. 4,411,768. In these systems, the hydrogen partial pressure declines due to the consumption of hydrogen and the production of light hydrocarbon vapors from the cracking of the heavier liquid fractions and the concentration of lighter and typically more paraffinic liquid components increases with increasing residuum conversion. This reduction in hydrogen partial pressure and increase in concentration of lighter more paraffinic constituents results in an increase in sediment formation, limiting the residuum conversion level which can be attained based on either product quality or reactor operability constraints.

SUMMARY OF THE INVENTION

The object of the present invention is to reduce the sediment formation and increase the conversion levels for a high boiling hydrocarbon feedstock in a catalyst bed hydrogenation process with a plurality of reactors in series. The invention involves the introduction of an interstage feed between the series of reactors comprising an aromatic solvent and/or a portion of the high boiling hydrocarbon feedstock.

BRIEF DESCRIPTION OF THE DRAWING

The drawing is a process flow diagram illustrating the process of the present invention.

DETAILED DESCRIPTION OF THE INVENTION

The present invention relates to a process employing multiple stage catalyst bed hydrocracking and using a plurality of catalyst bed reactors in series. Although the invention is applicable to either ebullating bed reactors or fixed bed reactors, the invention will be described in detail in reference to ebullating bed reactors.

Referring to the drawing, a heavy, high boiling feed 10 of feedstock material 11 is heated in feed heater 12 to the temperature required for the catalytic hydrogenation reaction, usually in the range from 650° F. to 725° F. The heated feed 14, primarily components boiling above 975° F., is combined in the feed mixer 16 with a hydrogen-rich stream 18 which has been heated in the hydrogen heater 20 to a temperature typically ranging from 650° F. to 1025° F. This hydrogen-rich stream 18 represents a portion of the total hydrogen-rich gas stream 22 composed of purified recycle gas or make-up hydrogen or a combination of both. The other portion 24 of the recycle gas stream 22, which is also heated at 20, is fed to the second ebullating catalyst bed reactor as will be described later.

The heated mixture 26 of hydrogen and feed material is introduced into the bottom of the ebullating catalyst bed reactor 28. Such reactors containing an expanded bed of hydrogenation catalyst are well known in the art. The hydrogenation catalysts suitable for hydrocracking and hydrotreating heavy, high boiling hydrocarbons are also well known and include but are not limited to nickel-molybdate, cobalt-molybdate and cobalt-nickel-molybdate with these catalyst materials typically carried on supports such as alumina. A typical operating temperature for the reactor 28 is in the range of 750 to 840° F.

The liquid portion of stream 30 from reactor 28 contains the partially converted materials having a boiling range from less than 350° F. to over 975° F. The nature of this stream 30 is typically as follows:

| Fraction | Boiling Range | Wt. % |
|---|---|---|
| Unconverted heavy oil | 975° F.+ | 35–70% |
| Vacuum gas oil | 650–975° F. | 20–60% |
| Atmospheric gas oil | 350–650° F. | 5–20% |
| Naphtha | 350° F.− | 1–5% |

This stream 30 is mixed at 42 with hydrogen-rich gas stream 44, a portion 24 of which has been heated in 20, typically to 650° F. to 1025° F., with the remainder 38 supplied at a temperature of between 200° F. to 650° F. Also mixed with the stream 30 in accordance with the present invention is an interstage feed 32 which is composed of a portion 34 of the high boiling feedstock material 11 and/or an aromatic solvent 36 such as cat cracker light cycle oil, heavy cycle oil or decant oil. The resulting mixture 50 is then sent to the second ebullating catalyst bed reactor 46.

Introducing this stream 32 directly into the second reactor 46 which operates at the highest severity and residuum conversion level, acts to limit the sediment formation compared with the usual commercial practice where all of the aromatic solvent is introduced into the first reactor. As a result, for a given quantity of aromatic solvent, the preferential introduction of this solvent into the second reactor will extend the residuum conversion level at which the unit can be operated. Also, the injection of a portion of the heavy high boiling feed directly into the second reactor acts to reduce sediment formation, allowing residuum conversion levels to be increased by increasing the resin to asphaltene concentration ratio in the liquid phase in the second reactor.

The introduction of 5 to 10 volume % (about the same value in weight %) of an aromatic solvent (based on the weight of the feed), such as cat cracker light cycle oil, heavy cycle oil or decant oil, into the second reactor reduces the sediment formation, as measured by SMS-2696, by 0.1 to 0.2 wt. % for a given level of residuum conversion. As a result, for a given unconverted residue product sediment specification and/or reactor heavy oil sediment limit, it has been determined that residuum conversion can be increased 3 to 5%. Alternatively, for given unconverted product sediment and residuum conversion levels, the catalyst replacement rate can be reduced 10 to 20%.

Instead of or in addition to the introduction of the aromatic solvent, 10 to 20% of the heavy high boiling residuum feedstock material may be fed directly into the second reactor. This also acts to reduce sediment formation by increasing the resin to asphaltene concentration ratio in the liquid phase in this reactor. As a result, residuum conversion levels can be increased an additional 2 to 3%. Further, the introduction of unconverted resin acts to redissolve sediment which has been formed as a result of hydrocracking the residuum in the first reactor.

The feed 50 to the second reactor 46 undergoes further hydrocracking in this reactor producing the effluent 52 which is fed to the high pressure separator 54 along with quench oil 56, if required, to reduce the temperature and coking tendency of the liquid. Depending on the application, the vapor 58 from the separator 54 may then be fed to a wash tower 60 where it is contacted with wash oil 62, typically having a boiling range of 500° F. to 975° F. The wash oil 62 could either be derived internally from the process or supplied externally from other refinery process units. The resulting vapor product 64 from the wash tower 60 is typically cooled 30° F. to 70° F. by contact with the wash oil 62. As a result, entrainment of residuum plus the content of residuum boiling fractions (975° F. +X), in equilibrium with the liquid phase, in stream 64 is significantly reduced. The vapor product from the wash tower can then either be cooled and purified and recycled back to reactors 28 and 46 or alternatively first be processed through in-line hydrotreating and/or hydrocracking reactors along with other internally derived intermediate liquid products or externally supplied distillate boiling range feeds. The liquid 66 from the wash tower 60 composed of remaining unvaporized constituents of the wash oil 62 plus residuum removed from stream 58 is combined with the liquid 55 from separator 54 containing unconverted residuum plus lighter boiling fractions resulting from conversion of the residuum in reactors 28 and 46. This combined heavy oil liquid stream 67 is then flashed in the heavy oil flash drum 68. The resulting flashed vapor 69 is then cooled by heat exchange. The partially cooled stream is then separated in 70. The separated vapor 71 is then further cooled after which it undergoes further separation in 72 producing a cooled hydrogen-rich vapor 74 which is typically recycled after further purification. The hydrocarbon liquids recovered from cooling and separating the vapor streams are collected in the flash drums 70 and 72. The resulting liquid products, 78 and 80 plus the flashed heavy oil 76, as well as liquid recovered from the vapor 64 are typically routed to a fractionation system for separation and further processing.

What is claimed is:

1. A method of hydrocracking a high boiling hydrocarbon feedstock comprising the steps of:

a. partially hydrocracking a feed portion of said feedstock comprising contacting said feed portion with hydrogen in a first reactor containing a bed of catalyst particles thereby forming an effluent mixture of $C_4$-light ends and lower boiling hydrocarbons and higher boiling hydrocarbons;

b. blending an aromatic solvent with said effluent mixture thereby forming a blended effluent mixture, said aromatic solvent comprising from 5 to 10 volume % of the volume of said feed portion;

c. further hydrocracking said blended effluent mixture comprising contacting said blended effluent mixture with hydrogen in a second reactor containing a bed of catalyst particles thereby forming a further effluent stream containing additional lower boiling hydrocarbons and the remaining unconverted higher boiling hydrocarbons; and d. separating said further effluent stream into a plurality of hydrocarbon product streams.

2. A method as recited in claim 1 wherein said lower boiling hydrocarbons boil below about 650° F. and said higher boiling hydrocarbons boil above about 650° F.

3. A method as recited in claim 1 wherein said first and second reactors are ebullating bed reactors.

4. A method as recited in claim 1 wherein said first and second reactors are fixed bed reactors.

5. A method as recited in claim 1 wherein each of said first and second reactors are selected from fixed bed and ebullating bed reactors.

6. A method as recited in claim 1 and further comprising blending a second portion of said feedstock with said effluent mixture to form said blended effluent mixture wherein said second portion of said feedstock comprises from 10 to 20 volume % of said feed portion of said feedstock.

* * * * *